US007681352B2

(12) United States Patent
Fu et al.

(10) Patent No.: US 7,681,352 B2
(45) Date of Patent: Mar. 23, 2010

(54) UNDERWATER GUN COMPRISING A VALVE-TYPE BARREL-SEAL

(75) Inventors: Jyun-Horng Fu, Centreville, VA (US); Robert James Howard, Clifton, VA (US); Antonio Paulic, Arlington, VA (US); John W. Rapp, Manassas, VA (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 12/165,060

(22) Filed: Jun. 30, 2008

(65) Prior Publication Data

US 2009/0320345 A1 Dec. 31, 2009

(51) Int. Cl.
*F41C 9/06* (2006.01)
*F41A 35/00* (2006.01)
*F41A 35/02* (2006.01)

(52) U.S. Cl. ..... 42/1.14; 89/31

(58) Field of Classification Search ..... 42/1.14; 89/1.809, 1.81, 5, 31; 114/18, 19
See application file for complete search history.

(56) References Cited

U.S. PATENT DOCUMENTS 1,271,640 A * 7/1918 Wentling ..... 89/5
1,525,359 A * 2/1925 Bjorklund ..... 114/238
1,658,004 A * 1/1928 Methlin ..... 114/238
3,807,274 A * 4/1974 Cohen ..... 89/1.81
4,848,210 A * 7/1989 Bissonnette ..... 89/1.81
5,231,241 A * 7/1993 Bissonnette ..... 89/1.81
5,277,144 A * 1/1994 Moody ..... 114/319
5,438,948 A * 8/1995 Moody ..... 114/319
5,639,982 A 6/1997 Cipolla
5,648,631 A 7/1997 Kirschner et al.
5,687,501 A 11/1997 Stace et al.
5,746,018 A 5/1998 Kirschner et al.
5,911,568 A * 6/1999 Kirschner et al. ..... 42/1.14
5,966,858 A 10/1999 Curtis et al.
6,701,819 B1 3/2004 Williams et al.
6,854,409 B1 * 2/2005 Galliano ..... 114/238
7,128,013 B1 * 10/2006 Plunkett et al. ..... 114/238
7,237,353 B1 7/2007 Beauchamp et al.

* cited by examiner

*Primary Examiner*—Bret Hayes
(74) *Attorney, Agent, or Firm*—DeMont & Breyer, LLC

(57) ABSTRACT

An apparatus and method for sealing the barrel of an underwater gun between firings is disclosed. The apparatus comprises a valve that is moved between a sealing and non-sealing state by a valve-actuator. In some embodiments, the valve actuator is driven by gases that result when a round is fired.

20 Claims, 4 Drawing Sheets

UNDERWATER GUN COMPRISING A VALVE-TYPE BARREL-SEAL

CROSS REFERENCE TO RELATED APPLICATIONS

This case is related to the following U.S. patent application Ser. Nos.: 12/165,066 (Underwater Gun Comprising a Barrel-Adapter including a Barrel Seal), 12/165,079 (Underwater Gun Comprising a Plate-Type Barrel Seal), 12/165,079 (Underwater Gun Comprising a Passive Fluidic Barrel Seal), and 12/165,090 (Underwater Gun Comprising a Turbine-Based Barrel Seal), all of which were filed on even date herewith and all of which are incorporated by reference herein.

FIELD OF THE INVENTION

The present invention relates to underwater guns.

BACKGROUND OF THE INVENTION

Underwater guns are useful as anti-mine and anti-torpedo devices. Recently, autonomous underwater vehicles (AUVs) have been fitted with underwater guns for torpedo defense and underwater "hunter-killer" CONOPs.

A gun, especially one with a high muzzle velocity, cannot be fired when water is in its barrel. If a firing where to incur in a water-filled barrel, a very high breach pressure would result as the ignited propellant charge forces (or tries to force) the water out of the barrel. The likely result would be material failure of the barrel.

The prior art is replete with approaches for waterproofing the barrel of an underwater gun, or for clearing water from its barrel before firing. U.S. Pat. No. 5,639,982 discloses a means for firing a fully automatic gun underwater using a blank barrel-clearance round. Blank barrel-clearance rounds are alternated with live rounds of ammunition. To begin the process, a blank barrel-clearance round is first detonated. This creates gas and steam within the chamber that forms a bubble at the muzzle end of the barrel, thereby displacing water from the chamber. A live round is then immediately fired. The process is repeated, whereby the subsequent detonation of a blank barrel-clearance round displaces any water that has re-entered the barrel subsequent to the firing of the live round.

U.S. Pat. No. 5,648,631 discloses a spooled tape seal for sealing the barrel of an underwater gun. The system includes a tap that covers the opening of the gun barrel and sprockets for advancing the tape across the opening. Hydrostatic pressure keeps the tape pressed to the end of the barrel to create an effective seal. When a bullet is fired, it perforates the tape. During this brief period of egress, the exhaust gases from combustion of the propellant charge keep water from entering the barrel. Almost immediately, a non-perforated portion of the tape is advanced by the sprockets to cover the barrel opening. External hydrostatic pressure re-seats the tape, thereby preventing water from entering the barrel.

U.S. Pat. No. 5,687,501 discloses a sealing plate for providing a watertight seal for a multi- or single-barreled underwater gun. The sealing plate provides one or more firing apertures in an otherwise solid surface. Between firings, the gun muzzle is sealed by a solid surface of the sealing plate. To fire a bullet, the sealing plate or muzzle rotates to align the gun muzzle with one of the firing apertures. This permits unimpeded egress. After the bullet fires, the plate or muzzle again rotates so that a solid portion of the sealing plate covers the muzzle.

These are but a few of the many patents pertaining to various aspects of underwater gun design in general, and to the water-in-the-barrel problem, in particular. Not with standing the many approaches to the problem, no truly satisfactory approach has been developed for keeping water out of the barrel of an underwater gun between and during operation.

SUMMARY OF THE INVENTION

The present invention provides an underwater gun having a barrel seal for preventing water from entering the barrel between the firing of rounds.

In the illustrative embodiment, the barrel seal is a valve that is disposed in the barrel of a gun. The valve is operatively coupled to a valve actuator. The valve actuator is operable to open or close the valve, thereby unsealing or sealing the barrel.

In accordance with the invention, the valve can be any of a variety of different types of valves, including, without limitation, a gate valve, a ball valve, and an iris valve. Furthermore, the valve actuator can take any one of a variety of different forms, such as, without limitation, a cylinder and piston arrangement or a motor. In some embodiments, the valve actuator includes, as a function of valve type, an arrangement for converting linear motion (e.g., of a piston, etc.) to rotational motion (e.g., to rotate the valve, etc.).

In various embodiments, the valve actuator is driven via different forms of power. For example, in some embodiments in which the valve actuator comprises a cylinder and piston, the valve actuator is driven by the combustion gases that are generated as the round's chemical propellant is ignited during firing. In some other embodiments, the valve actuator is driven by electricity or hydraulics, among other forms of power.

DETAILED DESCRIPTION

The terms appearing below are defined for use in this specification, including the appended claims, as follows:

Axially-oriented (or axial orientation) refers to an orientation that aligns with the longitudinal axis of an element. This orientation is orthogonal to a radial orientation.

Barrel is a narrow, hollow cylindrical portion of a firearm through which a projectile travels.

Bore is the hollow portion of the barrel through which a projectile travels during its acceleration phase.

Breech is an opening in the rear of a barrel of a gun where projectiles can be loaded.

Chamber is the portion of a barrel where a projectile is placed just prior to being fired. This is a high pressure containment area which is very precisely aligned with the bore of the barrel.

Fluidically coupled or fluidic communication means that liquid, gas, or vapor from a first region can flow to or otherwise affect a second region. For example, if two regions are fluidically coupled (or in fluidic communication), a pressure change in one of those regions might result in a pressure change in the other of the regions.

Muzzle is the opening at an end of the barrel where a projectile that has been fired exits the barrel.

Operatively coupled means that the operation of one device affects another device, wherein the devices need not be physical attached to one another. For example, a laser and a mirror are operatively coupled if a laser directs a beam of light to the mirror. An actuator and a valve are operatively coupled if the actuator actuates the valve, regardless of whether there other intermediary mechanisms between the actuator and the valve. Operatively-coupled devices can be coupled through any medium (e.g., semiconductor, air, vacuum, water, copper, optical fiber, etc.) and involve any type of force. Consequently, operatively-coupled objects can be electrically-coupled, hydraulically-coupled, magnetically-coupled, mechanically-coupled, optically-coupled, pneumatically-coupled, thermally-coupled, etc.

Radially-oriented (or radial orientation) refers to an orientation that is coincident with the radial direction of an element. See "axially-oriented."

The present invention pertains to guns that are intended for (1) use in an underwater environment and (2) firing rounds that include a chemical propellant. The underwater guns described herein will typically, although not necessarily, be fitted to AUVs. For clarity, gun 100 is typically depicted in the Figures as having a single round in the chamber or bore. It is to be understood, however, that gun 100 is typically a multi-shot weapon.

Figure 1:
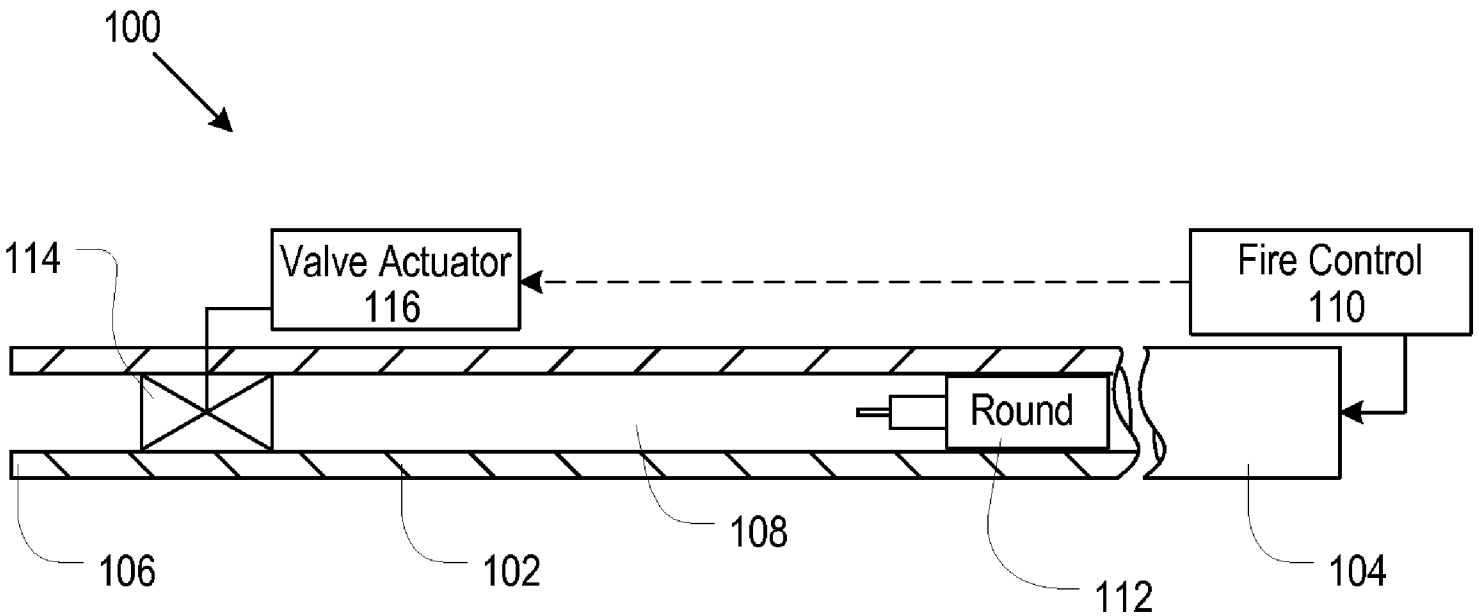
FIG. 1 depicts an underwater gun having a valve-type barrel seal in accordance with the illustrative embodiment of the present invention.

FIG. 1 depicts underwater gun 100 having a valve-type barrel seal in accordance with the illustrative embodiment of the present invention. Gun 100 includes barrel 102, chamber 104, bore 108, fire-control system 110, valve 114, and valve actuator 116, interrelated as shown. A live round 112 is depicted in bore 108.

Barrel 102, chamber 104, and bore 108 are conventional features of most guns. Fire-control system 110 is basically a computer and ancillary elements that enable gun 100 to hit a target. The relative sophistication of any particular embodiment of fire-control system 110 is primarily a function of the intended application for gun 100. That is, a relatively more sophisticated fire-control system is required for a relatively more autonomous application (e.g., for use in conjunction with an AUV, etc.).

In a typical embodiment, fire-control system 110 interfaces with one or more sensors (e.g., sonar, radar, infra-red search and track, laser range-finders, water current, thermometers, etc.). The sensor input is used to develop a firing solution for a target. To the extent that gun 100 is located on an AUV, etc., fire-control system 110 advantageously takes into account movements of the AUV itself. And, when associated with an AUV, fire-control system 110 is operatively coupled to aiming and firing mechanisms.

The fire-control system is not particularly germane to an understanding of the invention and, furthermore, is well understood by those skilled in the art. As a consequence, fire-control system 110 will not be described in further detail.

Valve 114, which in the illustrative embodiment is disposed at the muzzle end 106 of barrel 102, functions as a barrel seal for gun 100. Valve 114 has two primary states: one state in which the valve is "closed" and another state in which the valve is "open." When valve 114 is closed, it prevents water from advancing into barrel 102. When valve 114 is open, it unseals barrel 102, thereby enabling round 112 to be fired.

Valve 114 is controlled (i.e., moved between the two states) by valve actuator 116. A variety of different actuation schemes can be used to actuate valve 114. The selection of a particular type of actuator is dependent, to some extent, upon the specifics of valve 114 (e.g., gate valve, ball valve, iris valve, etc.) and the form of the power being used to drive actuator 116 (e.g., electricity, gas, etc.).

In some embodiments, valve actuator 116 is operatively coupled to fire-control system 110. This might be required to time the opening of valve 114 with the firing of a round, as a function of the actuation system.

This specification now proceeds with a description of several embodiments of underwater gun 100. These embodiments are distinguished from one another by the specifics of valve 114 and/or valve actuator 116.

Figure 2:
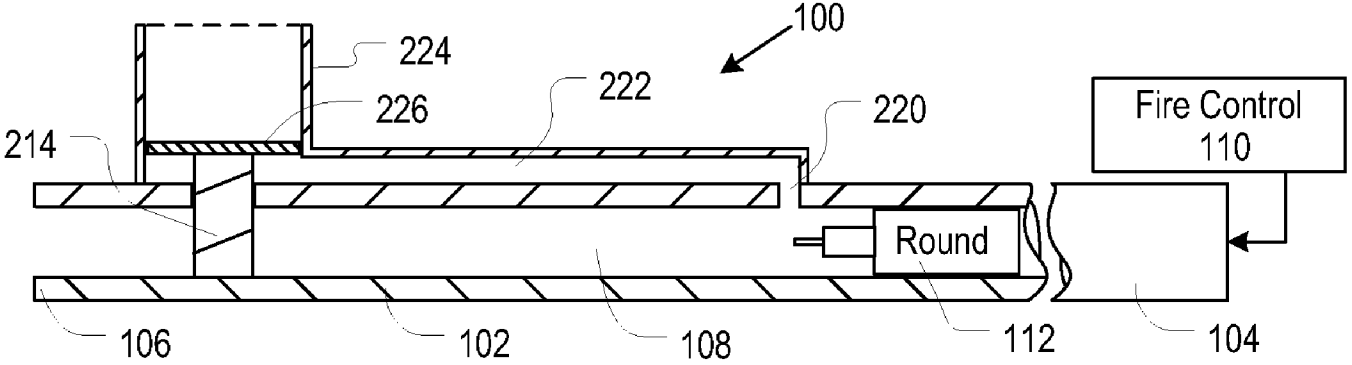
FIG. 2 depicts a first embodiment of the underwater gun of claim 1, wherein the valve is a gate valve having a piston-based actuation system, wherein the piston is driven by combustion gases.
Figure 3:
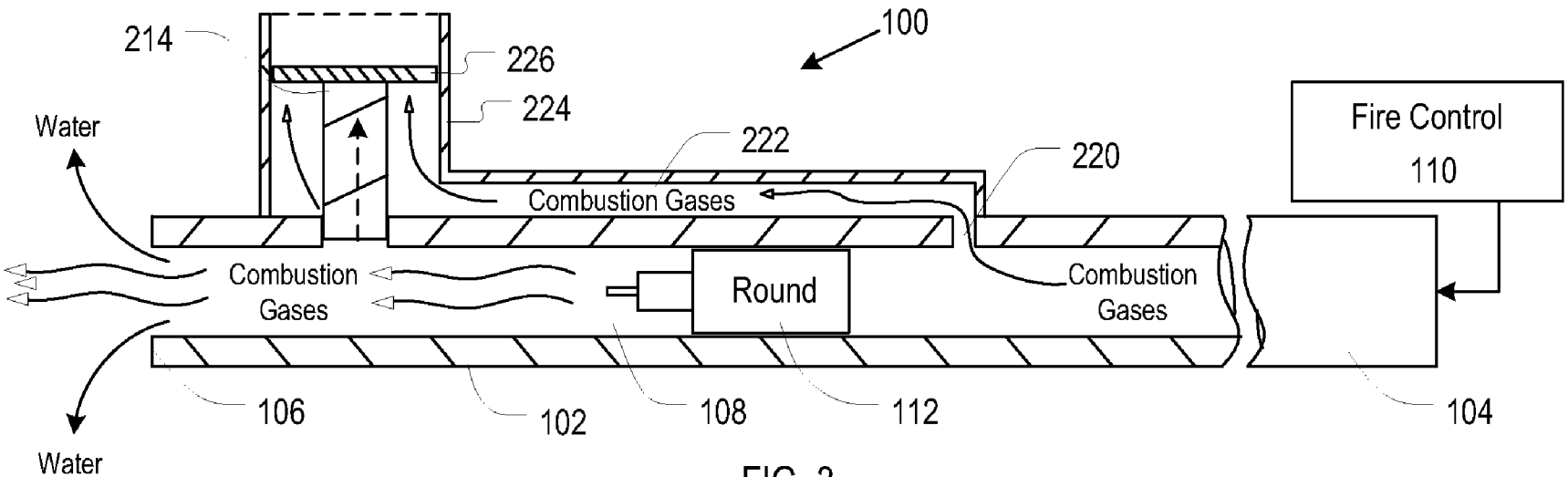
FIG. 3 depicts the underwater gun of FIG. 2 in a firing state.

FIGS. 2 and 3 depicts underwater gun 100 in which:

the valve is a gate valve;

the valve actuator comprises a piston and cylinder; and the valve actuator (a piston and cylinder arrangement) is driven by gases generated upon combustion of the projectile's chemical propellant.

FIG. 2 depicts the barrel of gun 100 in a sealed state (i.e., valve closed) and FIG. 3 depicts gun 100 during the firing of a live round (i.e., valve open).

Gun 100 of FIG. 2 includes barrel 102, bore 108, fire-control system 110, gate valve 214, gas port 220, channel 222, cylinder 224, and piston 226, interrelated as shown. Live round 112 is depicted in bore 108.

FIG. 2 depicts gate valve 214 in a closed position. In this position, the gate valve seals barrel 102 against water intrusion. For the embodiment of gun 100 that is depicted in FIG. 2, some amount of water will of course be resident in the barrel between valve 214 and muzzle end 106 of barrel 102 when gate valve 214 is closed.

With reference to FIG. 3, when round 112 is fired, combustion gases are generated (upon ignition of the round's chemical propellant). Combustion generates high pressures in bore 108 and the gun's chamber (not depicted). Some of these gases exit bore 108 through gas port 220. Those gases that exit through gas port 220 are conducted, via channel 222, beneath piston 226 in cylinder 224. The increase in pressure in the region beneath the piston forces the piston "upward" (i.e., away from barrel 102). As piston 226 rises through cylinder 224, gate valve 214 is withdrawn from barrel 102.

Upon firing, some of the combustion gases are blown out of muzzle end 106 of bore 108. This has the effect of clearing any water that was residing in barrel 102 "downstream" of valve 214.

To the extent that gun 100 continues to fire rounds, the substantially continuous generation of combustion gases will support piston 226 such that valve 214 remains in its "open" state. As a consequence, bore 108 remains open to permit rounds to be fired from gun 100.

In some embodiments, cylinder 224 is closed to the ambient environment. In such embodiments, a spring or other device (not depicted) that is arranged to provide a restoring force is disposed within cylinder 224. The restoring force urges piston 226 back toward barrel 102. Once firing ceases, the pressure rapidly decreases in the region below piston 226 such that there will be insufficient pressure to overcome the restoring force that is provided by the spring, etc. As a consequence, piston 226 drops and valve 214 re-seats in barrel 102, thereby blocking bore 108.

In some other embodiments, cylinder 224 is open to the ambient environment. In such an embodiment, the ambient water pressure bearing on piston 226 provides the restoring force that would otherwise be provided by a spring or other mechanism in a closed cylinder.

In the embodiment of gun 100 that is depicted in FIG. 2, the valve actuator (i.e., piston 226 and cylinder 224) does not react to commands from fire-control system 110. The response of the valve actuator is "automatic;" that is, it is based on the increase in pressure in the gun as a consequence of the combustion of a round's chemical propellant.

Notwithstanding the aforementioned "automatic" valve actuation, timing of the valve's movement is important. It can be readily determined how much time is required for a round to reach the location of the valve, how much force is available from combustion to operate the valve actuator, and how much force will be required to actuate the valve and cause it to open with the requisite speed. As a function of the chemical propellant used in the round, the weight of the piston, and other factors, in some embodiments, a separate charge (in addition to the round's chemical propellant) will be required to actuate valve 214.

In fact, it is possible that valve 214 must start to move before live round 112 is fired. In such cases, a separate charge will be required, and it will need to be pre-fired (before the live round), so that pressure can build to a sufficient extent to move the piston.

Another way to address the timing issue is to provide a round that exhibits a staggered acceleration profile. In particular, a round is provided with two or more separate charges of chemical propellant, the ignition of which is staged. As a consequence, the round is first accelerated, compresses gas in bore 108 and decelerates briefly until valve 214 fully withdraws (i.e., opens), and then is re-accelerated with the ignition of the second charge of propellant.

In the illustrative embodiment that is depicted in FIGS. 2 and 3, the valve actuator is a piston and cylinder arrangement driven by combustion gases. In some other embodiments, other valve actuation arrangements known to those skilled in the art are suitably used, including, without limitation, a piston/cylinder arrangement that is hydraulically actuated, linkages that operably couple valve 214 to a motor, and the like. In these arrangements, valve actuation is not "automatic" in the sense previously described. As a consequence, in such embodiments, the actuation of valve 214 is responsive to information (e.g., a signal) from fire-control system 110. An example of an embodiment in which valve actuation is under the control of fire-control system 110 is described in conjunction with FIGS. 6-8.

Figure 4:
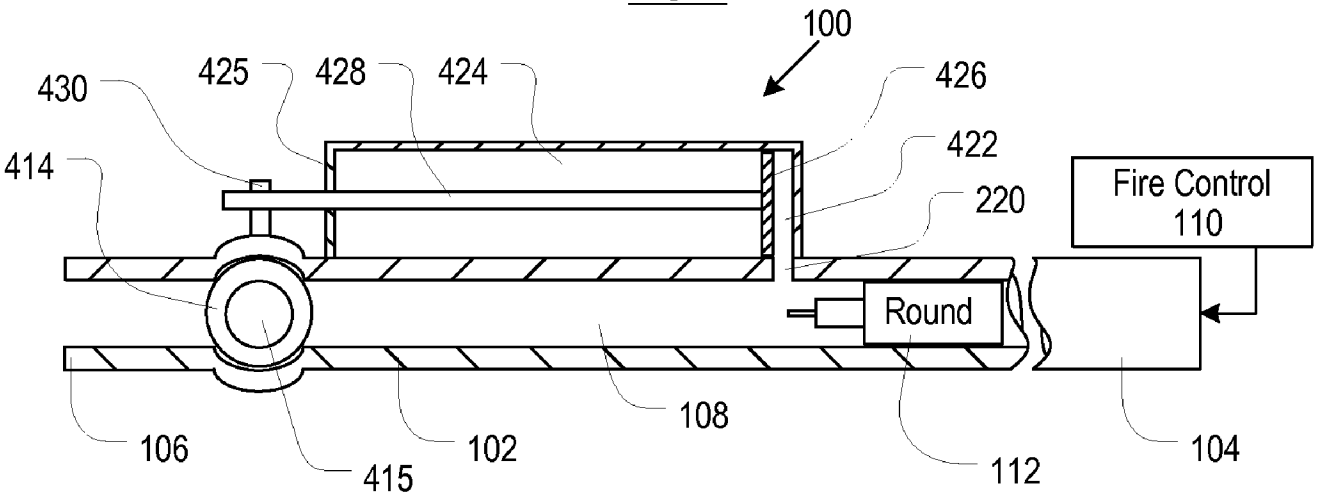
FIG. 4 depicts a second embodiment of the underwater gun of claim 1, wherein the valve is a ball valve having a piston-based actuation system, wherein the piston is driven by combustion gases.
Figure 5:
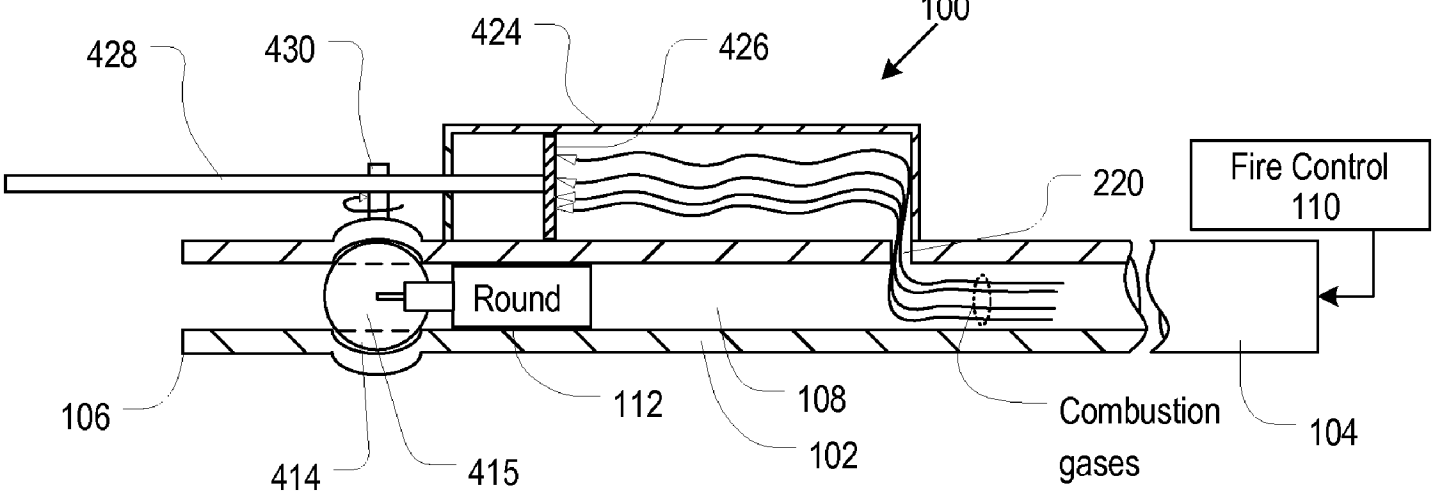
FIG. 5 depicts the underwater gun of FIG. 4 in a firing state.

FIGS. 4 and 5 depicts underwater gun 100 in which:

the valve is a ball valve;

the valve actuator comprises a piston and cylinder; and the valve actuator is driven by gases generated upon combustion of the projectile's chemical propellant.

FIG. 4 depicts the barrel of gun 100 in a sealed state (i.e., valve closed) and FIG. 4 depicts gun 100 during the firing of a live round (i.e., valve open).

Gun 100 of FIG. 4 includes barrel 102, bore 108, fire-control system 110, ball valve 414, gas port 220, cylinder 424, piston 426, rack 428, and pinion gear 430, interrelated as shown. Live round 112 is depicted in bore 108.

FIG. 4 depicts ball valve 414 in a closed position wherein valve orifice 415 does not align with bore 108 of barrel 102. In this position, ball valve 414 seals barrel 102 against water intrusion. For the embodiment of gun 100 that is depicted in FIG. 4, some amount of water will of course be resident in the barrel between valve 414 and muzzle end 106 of barrel 102 when ball valve 214 is closed.

Like the embodiment depicted in FIGS. 2 and 3, this embodiment of gun 100 also uses a piston and cylinder valve-actuation arrangement. Furthermore, rack 428 is coupled to piston 426 and extends through wall 425 of cylinder 424. Teeth (not depicted) that are formed on rack 428 operatively engage pinion gear 430. The pinion gear is, in turn, operatively coupled to ball valve 414. This rack and pinion arrangement converts the linear motion of piston 426 to rotational motion that is used to rotate ball valve 414 between an open position and a closed position.

Referring now to FIG. 5, when round 112 is fired, combustion gases are generated (upon ignition of the round's chemical propellant). Combustion generates high pressures in bore 108 and the gun's chamber (not depicted). Some of these gases exit bore 108 through gas port 220. Those gases that exit through gas port 220 are conducted to cylinder 424. The increase in pressure in region 422 near the entrance to cylinder 424 due to the presence of the combustion gases forces piston 426 to stroke through the cylinder.

As piston 226 advances through cylinder 224, pinion gear 430 is rotated via the movement of rack 428. In turn, ball valve 414 rotates from a closed state, as depicted in FIG. 4, to the open state that is depicted in FIG. 5. In the open state, valve orifice 415 aligns with bore 108 of barrel 102. Orifice 415 is, of course, appropriately sized to permit passage of round 112.

Upon firing, some of the combustion gases are blown out of muzzle end 106 of bore 108. This clears any water that resides in barrel 102 "downstream" of valve 414.

A torsion spring (not depicted) that is operatively coupled to the ball valve 414 provides a restoring force to return piston 426 to its rest position at the "bottom" of cylinder 424. When round 112 is first fired, the increase in pressure due to the rapid generation of combustion gases overcomes the restoring force of the spring and causes piston 426 to move through cylinder 424. But as the combustion gases dissipate, the pressure drops, and piston 426 returns to its rest position.

To the extent that gun 100 continues to fire rounds, the substantially continuous generation of combustion gases will support piston 426 such that valve 414 remains in its "open" state. As a consequence, bore 108 remains open to permit rounds to be fired from gun 100.

Like the embodiment of gun 100 that is depicted in FIGS. 2 and 3, the valve actuation system (piston 426, cylinder 224, etc.) does not react to commands from fire-control system 110. The response of the valve actuator is "automatic;" that is, it is based on the increase in pressure in the gun as a consequence of the combustion of a round's chemical propellant.

But as described in conjunction with the embodiment depicted in FIGS. 2 and 3, timing of the movement of valve 414 is important and is subject to the same considerations as valve 214, including the possibility of using a separate, pre-fired charge and the option of a round that uses a staggered acceleration profile.

Furthermore, in some other embodiments of gun 100, other valve actuation arrangements known to those skilled in the art are suitably used, including, without limitation, a piston/cylinder arrangement that is hydraulically actuated, linkages that operably couple valve 414 to a motor, and the like. In these arrangements, valve actuation is not "automatic" in the sense previously described. As a consequence, in such embodiments, the actuation of valve 414 is responsive to information (e.g., a signal) from fire-control system 110. An example of an embodiment in which valve actuation is under the control of fire-control system 110 is described below in conjunction with FIGS. 6-8.

Figure 6:
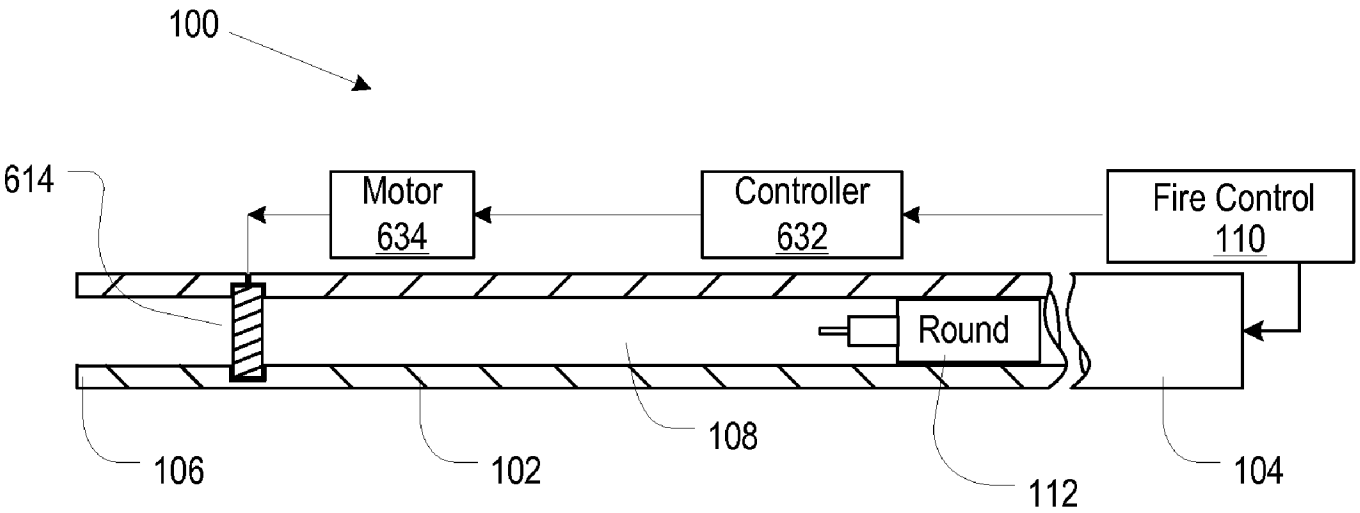
FIG. 6 depicts a third embodiment of the underwater gun of claim 1, wherein the valve is a iris valve having a motor-based actuation system.

FIG. 6 depicts underwater gun 100 in which:

the valve is an iris valve; and the valve actuator comprises a motor.

Gun 100 of FIG. 6 includes barrel 102, bore 108, fire-control system 110, controller 632, motor 634, and iris valve 614, interrelated as shown. Live round 112 is depicted in bore 108.

Figure 8:
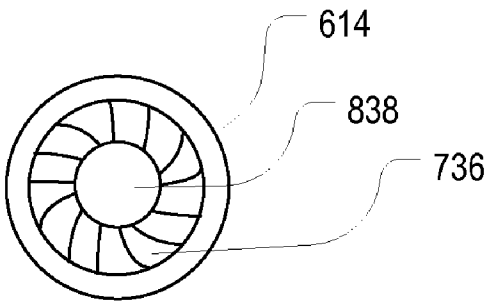
FIG. 8 depicts the iris valve of the underwater gun of FIG. 6 in an open state.
Figure 7:
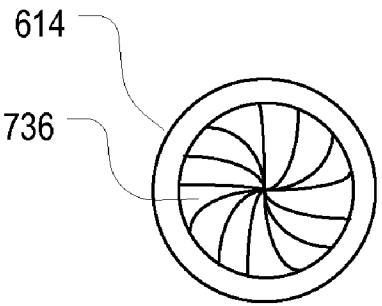
FIG. 7 depicts the iris valve of the underwater gun of FIG. 6 in a closed state.

FIG. 7 depicts iris valve 614 in a closed state and FIG. 8 depicts the iris valve in an open state. The iris valve comprises a plurality of leaves 736. Iris valves typically include a circumferentially-disposed rotatable ring that, when rotated, moves the leaves such that aperture 838 begins to form at the center of the valve. The aperture continues to open radially until it reaches its full size.

In the closed state, the iris valve seals barrel 102 against water intrusion. For the embodiment of gun 100 that is depicted in FIG. 6, some amount of water will of course be resident in the barrel between valve 614 and muzzle end 106 of barrel 102 when iris valve 214 is closed.

Iris valve 614 is operatively coupled, via appropriate linkages (not depicted), to motor 634. The motor, typically an electrical motor, drives the opening and closing of iris valve 614. In the previous embodiments, valve actuation was "automatic" in the sense that it was driven by combustion gases. But for the embodiment depicted in FIG. 6, the actuation of valve 614 is responsive to information coming from fire-control system 110.

More particularly, fire-control system 110 sends a signal to controller 632 at an appropriate time as a function of valve response, etc., to actuate motor 634 to change the state of valve 614. With regard to timing, it is possible that due to the response of valve 614, the valve might need to begin opening before a round is fired. In such a case, after fire-control system 110 has a solution but before it sends a command to fire, it sends a signal to controller 632 to begin opening valve 614. Valve 614 also closes via the action of fire-control system 110.

In some other cases, the fire-control system 110 sends a signal to controller 632 that indicates that a round is about to be fired. The controller then actuates motor 634 to open valve 614 after a first delay, wherein the delay is based on the time it takes for a pressure wave from combustion gases to arrive at the valve. In the case of the firing of a single round, valve 614 closes after a second delay, wherein the second delay is based on the time it takes for the round to transit valve 614.

The operation of this embodiment is analogous to the operation of an underwater camera. In fact, in a further embodiment, an electronically-controlled shutter such as adapted from an underwater camera serves as the valve-based barrel seal. The shutter is simply activated by fire-control system 110.

It is to be understood that the disclosure teaches just one example of the illustrative embodiment and that many variations of the invention can easily be devised by those skilled in the art after reading this disclosure and that the scope of the present invention is to be determined by the following claims.

What is claimed is:

1. An underwater gun, comprising:

a barrel, wherein the barrel has an axially-oriented bore;

a valve, wherein the valve is coupled to the barrel so that the valve is capable of (a) substantially sealing the barrel to prevent water entry in a first state and (b) unsealing the barrel to permit passage of a round through a muzzle of the barrel in a second state, and wherein, in the first state, the valve is disposed in the barrel; and a valve actuator, wherein the valve actuator is operably-coupled to the valve to move the valve between the first state and the second state, and wherein the valve actuator is actuated based on an increase in pressure as a consequence of combustion of chemical propellant.

2. The underwater gun of claim 1, wherein the valve actuator comprises:

a piston, wherein the piston is external to the barrel and is operably-coupled to the valve and arranged so that an outward stroke of the piston causes the valve to move the second state; and a cylinder, wherein the piston is disposed within the cylinder.

3. The underwater gun of claim 2 wherein the cylinder is open to the ambient environment and water pressure actuates a return stroke of the piston to move the valve to the first state.

4. The underwater gun of claim 2 wherein the cylinder is sealed to the ambient environment and further wherein the underwater gun further comprises a spring for actuating a return stroke of the piston to move the valve to the first state.

5. The underwater gun of claim 2 and further wherein the barrel further comprises a port that penetrates a wall of the barrel and is in fluidic communication with the cylinder to deliver combustion gases thereto, and further wherein the combustion gases are conducted by the port to a base of the cylinder thereby actuating the outward stroke of the piston.

6. The underwater gun of claim 5 wherein the valve is a gate valve, and wherein the barrel further comprises a slot that penetrates a wall of the barrel, and wherein the gate valve aligns with the slot, and further wherein the outward stroke of the piston causes the gate valve to withdraw from the barrel through the slot to permit passage of the round through the muzzle.

7. The underwater gun of claim 5 wherein the valve is a ball valve, and wherein the outward stroke of the piston causes the ball valve to turn and align an orifice of the valve with the bore of the barrel to permit passage of the round through the muzzle.

8. The underwater gun of claim 7 wherein the valve actuator further comprises a rack that is operatively engaged to a pinion gear, wherein the rack is driven by the piston, and wherein movement of the rack turns the pinion gear, thereby causing the ball valve to move between the first state and the second state.

9. The underwater gun of claim 2 further comprising an actuating round, wherein firing of the actuating round generates combustion gases that drive the outward stroke of the piston.

10. The underwater gun of claim 1 wherein the chemical propellant is associated with the round.

11. The underwater gun of claim 1 further comprising an actuating round, wherein the chemical propellant is associated with the actuating round.

12. The underwater gun of claim 1 wherein the valve is an iris valve, wherein the valve actuator receives a signal from a fire-control system of the underwater gun indicating that a round is about to be fired, and further wherein after receiving the signal, the valve controller opens the iris valve.

13. A method for operating an underwater gun having a barrel, wherein the method comprises:

loading at least one round in an underwater gun;

firing the round, thereby generating combustion gases; and directing the firing gases to a valve actuator comprising a piston and a cylinder, wherein the piston is disposed outside of the gun's barrel, wherein the firing gases drive an outward stroke of the piston, and further wherein the piston is operably coupled to a valve and the valve and piston are arranged so the outward stroke of the piston causes the valve to move to a state that permits passage of the round through a muzzle of the barrel.

14. An underwater gun having a barrel, wherein the gun comprises:

a valve, wherein the valve is coupled to the barrel so that the valve is capable of (a) substantially sealing the barrel to prevent water entry in a first state and (b) unsealing the barrel to permit passage of a round through a muzzle of the barrel in a second state, and wherein, in the first state, the valve is disposed in the barrel; and a valve actuator that is operably-coupled to the valve to move the valve between the first state and the second state, wherein the valve actuator comprises a cylinder and a piston disposed in the cylinder, and wherein the piston is external to the barrel and is operably-coupled to the valve and arranged so that an outward stroke of the piston causes the valve to move the second state, and further wherein the cylinder is open to the ambient environment and water pressure actuates a return stroke of the piston to move the valve to the first state.

15. An underwater gun having a barrel, wherein the gun comprises:

a valve, wherein the valve is coupled to the barrel so that the valve is capable of (a) substantially sealing the barrel to prevent water entry in a first state and (b) unsealing the barrel to permit passage of a round through a muzzle of the barrel in a second state, and wherein, in the first state, the valve is disposed in the barrel;

a valve actuator that is operably-coupled to the valve to move the valve between the first state and the second state, wherein the valve actuator comprises a cylinder and a piston disposed in the cylinder, and wherein the piston is external to the barrel and is operably-coupled to the valve and arranged so that an outward stroke of the piston causes the valve to move the second state; and a port that penetrates a wall of the barrel and is in fluidic communication with the cylinder to deliver combustion gases thereto, and further wherein the combustion gases are conducted by the port to a base of the cylinder thereby actuating the outward stroke of the piston.

16. The underwater gun of claim 15 wherein the valve is a gate valve, and wherein the barrel further comprises a slot that penetrates a wall of the barrel, and wherein the gate valve aligns with the slot, and further wherein the outward stroke of the piston causes the gate valve to withdraw from the barrel through the slot to permit passage of the round through the muzzle.

17. The underwater gun of claim 15 wherein the valve is a ball valve, and wherein the outward stroke of the piston causes the ball valve to turn and align an orifice of the valve with the bore of the barrel to permit passage of the round through the muzzle.

18. The underwater gun of claim 17 wherein the valve actuator further comprises a rack that is operatively engaged to a pinion gear, wherein the rack is driven by the piston, and wherein movement of the rack turns the pinion gear, thereby causing the ball valve to move between the first state and the second state.

19. An underwater gun having a barrel, wherein the gun comprises:

a valve, wherein the valve is coupled to the barrel so that the valve is capable of (a) substantially sealing the barrel to prevent water entry in a first state and (b) unsealing the barrel to permit passage of a round through a muzzle of the barrel in a second state, and wherein, in the first state, the valve is disposed in the barrel;

a valve actuator that is operably-coupled to the valve to move the valve between the first state and the second state, wherein the valve actuator comprises a cylinder and a piston disposed in the cylinder, and wherein the piston is external to the barrel and is operably-coupled to the valve and arranged so that an outward stroke of the piston causes the valve to move the second state; and an actuating round, wherein firing of the actuating round generates combustion gases that drive the outward stroke of the piston.

20. An underwater gun having a barrel, wherein the gun comprises:

an iris valve, wherein the valve is coupled to the barrel so that the valve is capable of (a) substantially sealing the barrel to prevent water entry in a first state and (b) unsealing the barrel to permit passage of a round through a muzzle of the barrel in a second state, and wherein, in the first state, the valve is disposed in the barrel; and a valve actuator, wherein the valve actuator is operably-coupled to the valve to move the valve between the first state and the second state upon receipt of a signal from a fire control system of the gun indicating that a round is about to be fired.

* * * * *